US006220742B1

(12) United States Patent
Lloyd et al.

(10) Patent No.: US 6,220,742 B1
(45) Date of Patent: Apr. 24, 2001

(54) HARMONIC LIGHTS

(75) Inventors: Barbara Lloyd; Scott Sulivan, both of Waterford, VA (US)

(73) Assignee: TSL, Limited Company, Waterford, VA (US)

( * ) Notice: Subject to any disclaimer, the term of this patent is extended or adjusted under 35 U.S.C. 154(b) by 0 days.

(21) Appl. No.: 09/324,518

(22) Filed: Jun. 3, 1999

(51) Int. Cl.[7] ..... F21W 121/00
(52) U.S. Cl. ..... 362/565; 362/806; 362/249
(58) Field of Search ..... 362/565, 806, 362/31, 27, 249

(56) References Cited

U.S. PATENT DOCUMENTS

| | | | |
|---|---|---|---|
| D. 301,760 | 6/1989 | Goutal | D26/113 |
| 303,359 | 8/1884 | Belcher . | |
| D. 398,066 | 9/1998 | Noel | D26/56 |
| 1,138,552 | 5/1915 | Goddard . | |
| 4,758,934 | 7/1988 | von Kohorn | 362/145 |
| 4,807,095 | 2/1989 | Bell | 362/127 |
| 4,812,954 | 3/1989 | Marton | 362/134 |
| 4,945,460 | 7/1990 | Von Kohorn | 362/290 |
| 4,957,785 | 9/1990 | Fornadley | 428/15 |
| 5,117,338 | 5/1992 | McCrary | 362/104 |
| 5,575,098 * | 11/1996 | Goettel-Schwartz | 362/800 X |
| 5,755,508 * | 5/1998 | Wheaton | 362/249 |
| 5,803,594 | 9/1998 | Frederickson et al. | 362/351 |
| 5,823,652 * | 10/1998 | Vann | 362/32 |

* cited by examiner

*Primary Examiner*—Laura K. Tso
(74) *Attorney, Agent, or Firm*—Robert Blackmon

(57) ABSTRACT

A novel and decorative lighting system for selectively conditioning the atmosphere surrounding the light including a glass base having a number of lighting elements incorporated into said base, and a plurality of translucent pebbles on top of said base to diffuse and direct the light from the lighting elements. A glass base has a number of holes provided in the base to receive the light bulbs or lighting elements. Colored translucent pebbles or similar objects are placed on top of the disk shaped glass base to diffuse and direct the light to provide a soothing atmosphere.

4 Claims, 2 Drawing Sheets

HARMONIC LIGHTS

BACKGROUND OF THE INVENTION

1. Field of the Invention

The present invention relates to a lighting apparatus for providing a decorative, novelty lighting system that is dynamically and easily changeable by altering the combination and content of translucent pebbles on top of a lighted, mirrored glass base.

2. Description of the Prior Art

In recent years the number of lighting fixtures and lighting methods available at a reasonable cost to a home owner has expanded to an all time high. There is a common thread and theme throughout the lighting industry however which still focuses on the purely functional application of light directed to a particular spot or diffused to light an extended area.

The sole exception seems to be decorative light which is complementary to art work, but the main focus of the lighting is still to direct or diffuse the light in such a way as to impact another object or display area.

Examples of lighting devices which are used in other than a strictly utilitarian application include U.S. Pat. No. 4,812,954 to Marton showing back lighting used to back light marble; U.S. Pat. No. 4,807,095 to Bell showing an arrangement of fiberoptics about a able to light the table; U.S. Pat. No. 1,138,552 to Goddard shows an illuminated mirror having a convex surface directing reflected light; U.S. Pat. No. 4,945,460 shows a back lit table having a number of light directing passages; and U.S. Pat. No. 4,758,934 shows back lighting for planted pots.

There is lacking still a choice of lighting devices which are purely decorative and mood affecting. The current invention teaches a glass base having a lighting system incorporated therein and the use of translucent objects including pebbles or jewels to affect a desirable pattern of lighting on the base and the surrounding area. The use a light bulb to heat scent-releasing pebbles was recognized in U.S. Design Patent D.301,760 to Goutal. U.S. Pat. No. 5,117,338 shows a light incorporated into a ring for spot-lighting a diamond. In addition, the incorporation of stones and glass for decorative, non-lighting applications was recognized in U.S. Pat. No. 303,359 to Belcher. U.S. Pat. No. 4,957,785 shows a light transmissive structure for a light fixture which is made from crystal clusters incorporated into a hemispherical shape.

None of the above inventions and patents, taken either singly or in combination, however, is seen to describe the instant invention as claimed.

SUMMARY OF THE INVENTION

Accordingly, it is a principal object of the invention to provide a decorative, novel lighting system which incorporates a base and a number of light altering objects on top of the lighting base to create a decorative lighting novelty system.

It is another object of the invention to provide a lighting system which uses stones, pebbles, or jewels to alter the light emanating from the base.

It is a further object of the invention to incorporate opaque of translucent pebbles to direct light from the lighting base in a decorative fashion.

Still another object of the invention is to provide micro-lighting in a glass plate attached to the base to distribute lighting around a novel lighting system to affect mood affecting lighting.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

The present invention is to a novel lighting apparatus. As best shown in the Figures, a lighting system ("light") 10 comprises a base ("tray") 12 carrying translucent pebbles 14. The base 12 is preferably made of glass, but may be made from any material, particularly synthetic, translucent materials such as clear or colored plastics or similar materials. The tray 12 is raised above the surface on which it sits by legs 16, which may be formed as oblong, pebble shaped members or may be columnar or similarly shaped.

Figure 3:
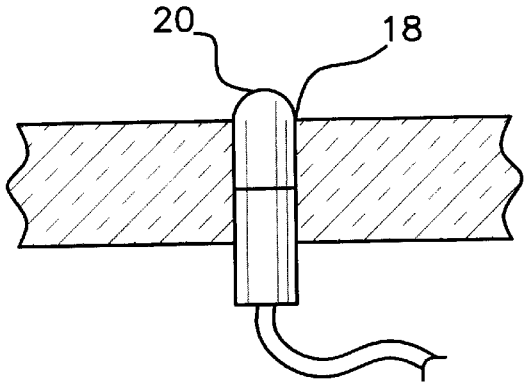
FIG. 3 is a break away view of the lighting apparatus showing an individual lighting element.
Figure 4:
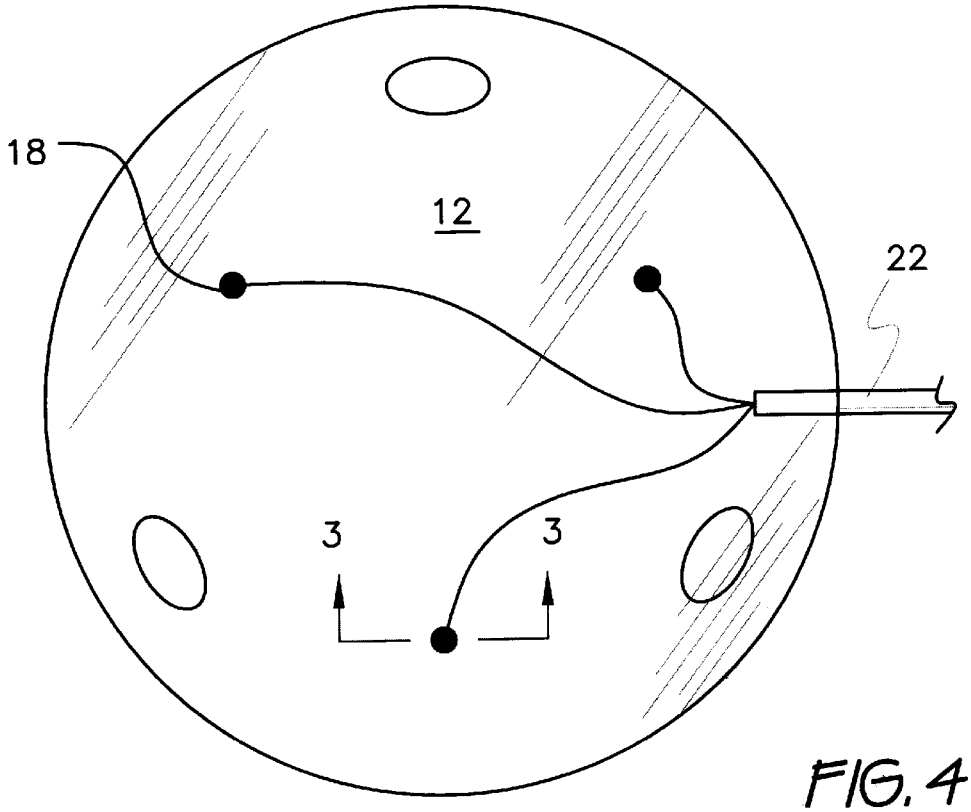
FIG. 4 is a bottom plan view showing the electrical connection of the lighting elements.

As best seen in FIGS. 3 and 4, the base has a number of lighting-element receiving holes or cut outs 18 about the base. These cut outs may extend entirely through the base or partially through, depending on the relative size of the light element 20 and the width of the base glass 12. The light elements ("bulbs") 20 are installed in the cut outs and held in place by friction, bayonet joints, adhesives, or similar fixtures for retaining the light bulb or element 20. Preferably three light bulbs 20 are provided on the base 12.

Appropriate electrical connectors such as lead wires 22 are connected between the light bulbs and an electrical outlet (not shown) or battery or appropriate power source locate on the lighting system or remotely therefrom. As is well known in the art, an appropriate switch (not shown) may be installed between the power source and the lighting elements to selectively provide power to the lighting elements.

Figure 1:
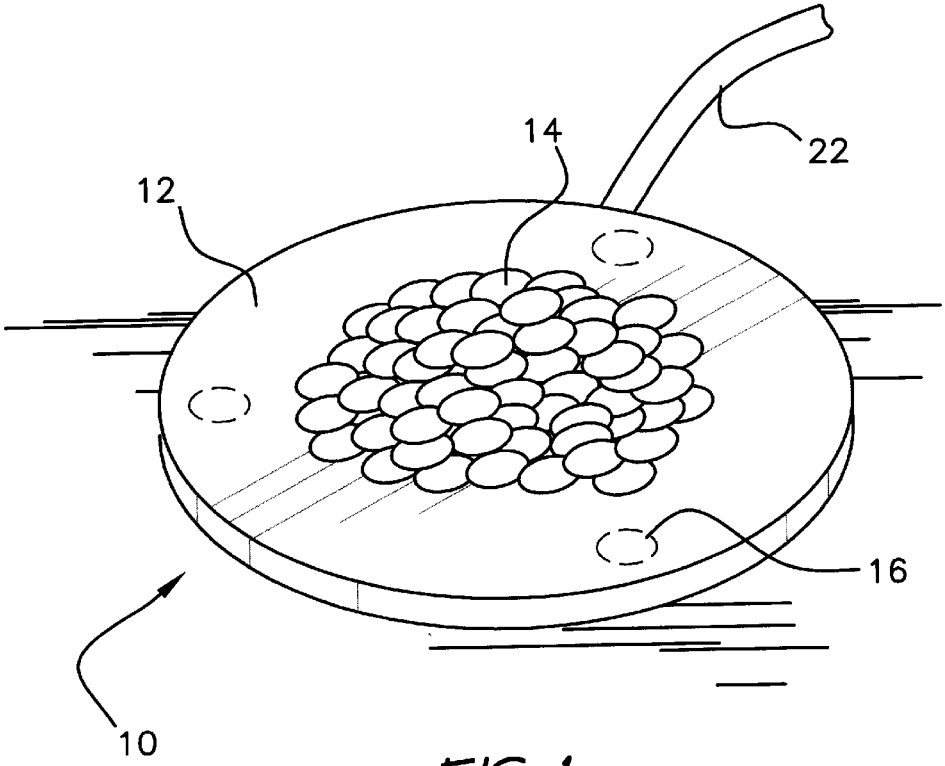
FIG. 1 is environmental view of a lighting apparatus according to the present invention.
Figure 2:
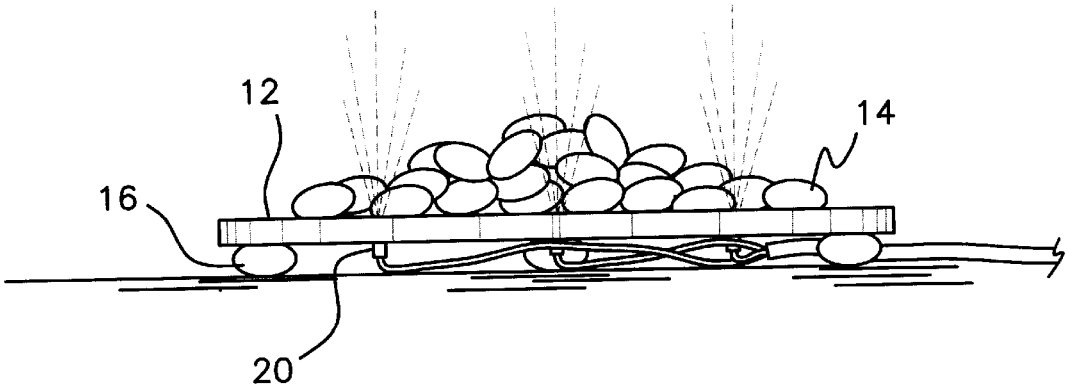
FIG. 2 is a side elevational view of the lighting apparatus according to the present invention.
Figure 5:
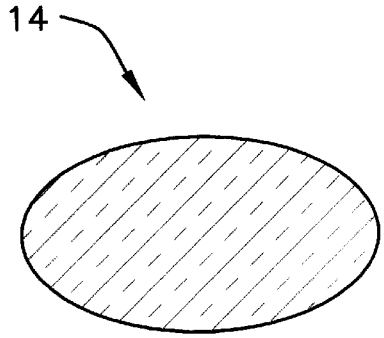
FIG. 5 is a cross-section of a translucent pebble for use with the current invention.

The top of the base 12 forms a tray for receiving objects 14 on top of the light 10 to diffuse or direct the light from the lighting elements 20. Preferably the objects 14 are translucent pebbles as shown in FIGS. 1, 2, and 5. Any number of other elements can be used in place of the pebbles, such as gems, artificial gems, artificial stones, colored glass, or reflective objects, or a combination thereof which will diffuse or direct the light in a manner favorable to the particular user. The base 12 can be flat or slightly convex or irregularly shaped to help retain or distribute the pebbles 14.

In use, the base 12 is fitted with lighting elements 20 into the cut outs 18 and connected to a power source (not shown) by electrical leads 22. The user then selects a number of translucent pebbles or similar light directing or diffusing objects 14 to place on top of the base tray 12. The lighting elements are then powered by the power source (not shown) to light the objects on the tray and in turn, the elements on the tray direct and diffuse the light in a decorative and novel fashion to provide an appropriate mood or atmosphere to the room.

It is to be understood that the present invention is not limited to the sole embodiment described above, but encompasses any and all embodiments within the scope of the following claims.

We claim:

1. A lighting system for providing decorative lighting to a surrounding area, comprising:

a translucent glass base having an upper surface for receiving light diffusing objects, said upper surface being substantially disk shaped;

a plurality of light diffusing elements received on said upper surface;

a plurality of means defining holes in said base for receiving a lighting element in each said plurality of means defining holes;

a plurality of lighting elements mounted in said plurality of holes;

electrical connectors connected between each of said lighting elements and a power source for lighting said lighting elements;

whereby said base upper surface is lighted by said lighting elements and said light diffusing elements on said upper surface diffuse said light in a predetermined manner.

2. A lighting system for lighting a room, comprising:

a glass base having a plurality of legs and an upper surface and a body;

a plurality of holes in said glass base body for each receiving lighting elements;

a plurality of lighting elements mounted in said plurality of holes;

an electrical connector for connecting said lighting elements to a power source; and a number of translucent pebbles on top of the base for diffusing and directing the light from said lighting elements in a predetermined manner.

3. A method of providing atmospheric light conditioning comprising the steps of:

(a) providing a translucent base having a substantially disk shaped body and an upper surface;

(b) providing a plurality of means defining holes in said disk shaped body for receiving lighting elements;

(c) installing at least one lighting element in at least one of said plurality of means defining holes;

(d) providing an electrical connector for providing electrical power to said at least one lighting element;

(e) placing at least one light diffusing element on top of said translucent base for diffusing light from said at least one lighting element in a predetermined manner.

4. The method of providing atmospheric light conditioning according to claim 3, wherein three means defining holes in said disk shaped body and three lighting elements are provided.

* * * * *